US006402564B1

(12) United States Patent
Shi et al.

(10) Patent No.: US 6,402,564 B1
(45) Date of Patent: Jun. 11, 2002

(54) LOW PROFILE MODULAR JACK

(75) Inventors: GuangXing Shi; Suiya Wang, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/994,430

(22) Filed: Nov. 26, 2001

(51) Int. Cl.[7] ..... H01R 24/00
(52) U.S. Cl. ..... 439/676
(58) Field of Search ..... 439/676, 344, 439/941

(56) References Cited

U.S. PATENT DOCUMENTS 6,066,005 A * 5/2000 Belopolsky ..... 439/676
6,095,869 A * 8/2000 Wang ..... 439/676

* cited by examiner

*Primary Examiner*—Tho D. Ta
(74) *Attorney, Agent, or Firm*—Wei Te Chung

(57) ABSTRACT

A modular jack (1) mounted on a printed circuit board includes an insulating housing (10) defining a first contact insertion hole (121) and a second contact insertion hole (122), and a first and a second contacts (20, 30) accommodated therein. The first contact insertion hole includes a first hole (1211), a second hole (1212) sized larger than the first hole, and a gap (1213) communicating therebetween. The first contact has a contact portion (21), an intermediate portion (23) received in the first hole, and a bent portion (25) received in the gap and a solder portion (22) received in the second hole.

6 Claims, 7 Drawing Sheets

LOW PROFILE MODULAR JACK

BACKGROUND OF THE INVENTION

1. Field of the Invention

The present invention relates to a modular jack, and particularly to a low profile modular jack terminating with wires.

2. Description of Prior Art

Modular jack-type connectors are widely used in telephone equipment and data processing equipment. Certain modular jack-type connectors are required to be mounted on a wall of a room, on a body of a telephone or on a printed circuit board, and terminate with wires at the end thereof to provide an electrical connection between the telephone equipment, or the data processing equipment, and an external line.

As disclosed in Taiwan Patent No. 102483, a conventional modular jack connecting with wires includes an insulating housing defining a plug insertion hole for receiving a modular plug therein and a plurality of contact insertion holes communicating with the plug insertion hole for receiving a plurality of contacts. The plurality of contact insertion holes are arranged in an upper row and a lower row and are staggered with each other. However, such an arrangement of the contact insertion holes inevitably results in an increased thickness of a bottom wall of the insulating housing, thereby occupying more space on a circuit board, and also increasing the production cost.

Hence, an improved modular jack is required to overcome the disadvantages of the prior art.

BRIEF SUMMARY OF THE INVENTION

A first object of the present invention is to provide an improved modular jack terminating with wires, the height of which is reduced.

A second object of the present invention is to provide an improved modular jack terminating with wires, which facilitates a soldering procedure between contacts of the modular jack and the wires.

A modular jack mounted on a printed circuit board and terminating with a pair of wires in accordance with the present invention, comprises an insulating housing having a top wall, a bottom wall and a pair of side walls with a plug insertion hole being defined therebetween adapted for receiving a complementary plug, and a pair of contacts received in the housing. A first contact insertion hole and a second contact insertion hole are defined in the bottom wall and communicate with a pair of channels defined at entrance of the plug insertion hole. The first contact insertion hole comprises a first hole, a second hole sized larger than the first hole, and a gap communicating the first hole with the second hole. Center lines of the first and the second holes are spaced from each other and fall on a same plane which is oblique to a mounting face of the bottom wall and forms an acute angle therebetween. The second contact insertion hole has a first passageway communicating with a corresponding channel and a second passageway sized larger than the first passageway. The pair of contacts includes a first conductive contact and a second conductive contact, which are received respectively in the first contact insertion hole and the second contact insertion hole. Each conductive contact has a contact portion extending backwards into the plug insertion hole, a transition portion received in a corresponding channel, an intermediate portion, and a solder portion correspondingly received in the second hole or passageway. The first contact further has a bent portion vertically connecting the intermediate portion with the solder portion.

Other objects, advantages and novel features of the invention will become more apparent from the following detailed description of the present embodiment when taken in conjunction with the accompanying drawings.

DETAILED DESCRIPTION OF THE INVENTION

Figure 1:
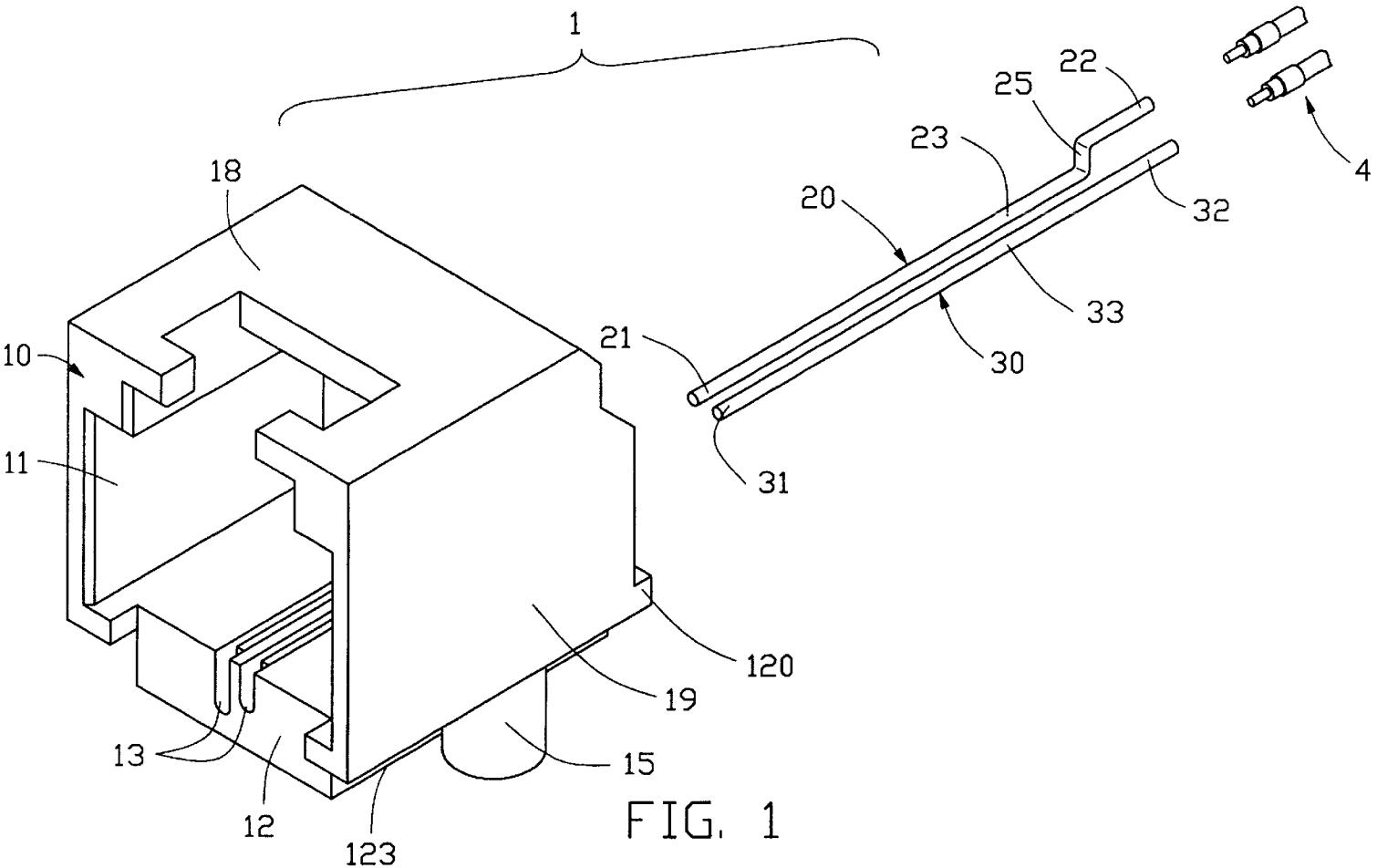
FIG. 1 is an exploded, perspective view of a modular jack in accordance with a first embodiment of the present invention, and a pair of wires for being terminated thereto.

Referring to FIG. 1, a modular jack 1 in accordance with a first embodiment of the present invention includes an insulating housing 10 and a pair of first and second conductive contacts 20, 30 for being received in the insulating housing 10. The pair of conductive contacts 20, 30 provide an electrical connection between a pair of wires 4 and a mating plug (not shown).

Figure 2:
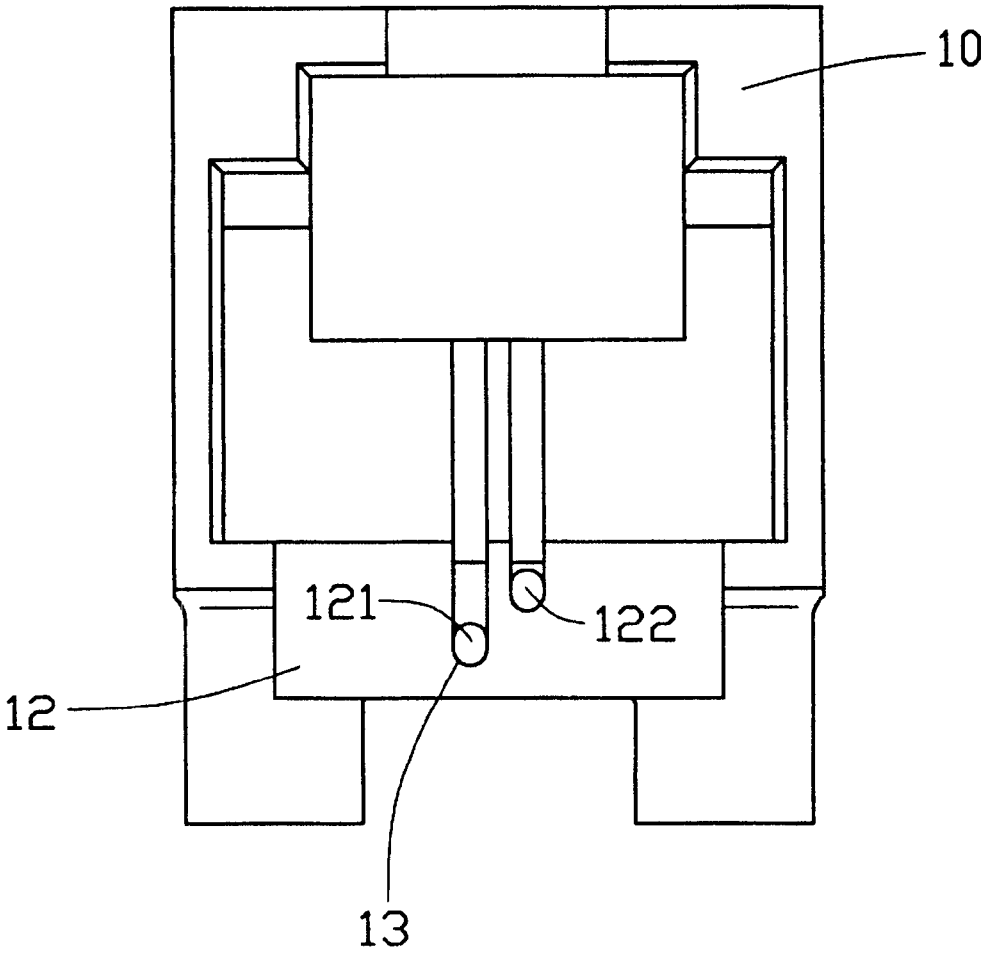
FIG. 2 is a front view of an insulating housing of the modular jack shown in FIG. 1.
Figure 6:
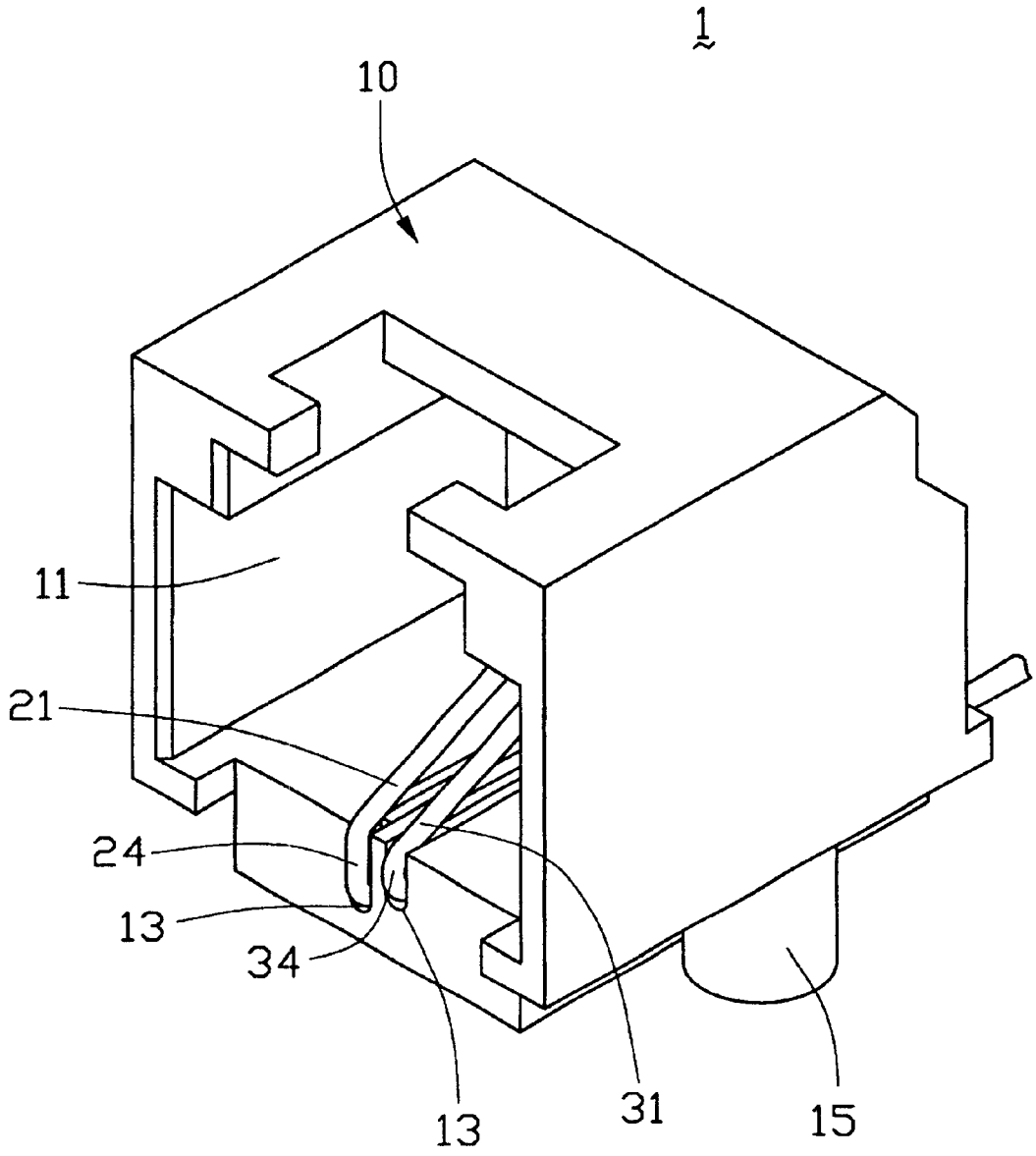
FIG. 6 is an assembled view of the modular jack shown in FIG. 1, with a first and second contacts inserted and bent and with the wires terminated thereto.

Also referring to FIG. 2, the insulating housing 10 has a top wall 18, a bottom wall 12 and a pair of side walls 19 with a plug insertion hole 11 being defined therebetween for receiving the mating plug. The bottom wall 12 defines a mounting face 123 on a bottom side thereof for engaging with a top face of a printed circuit board (not shown). A pair of posts 15 extend from opposite sides of the bottom wall 12 for securely positioning the housing 10 on the printed circuit board. A pair of first and second contact insertion holes 121, 122 are defined in the bottom wall 12, which will be described in greater detail hereinafter. The insulating housing 10 also defines a pair of offset channels 13 in a front end of the bottom wall 12 communicating the contact insertion holes 121, 122 with the plug insertion hole 11. The channels 13 receive transition portions 24, 34 of the contacts 20, 30 therein (FIG. 6).

Figure 3:
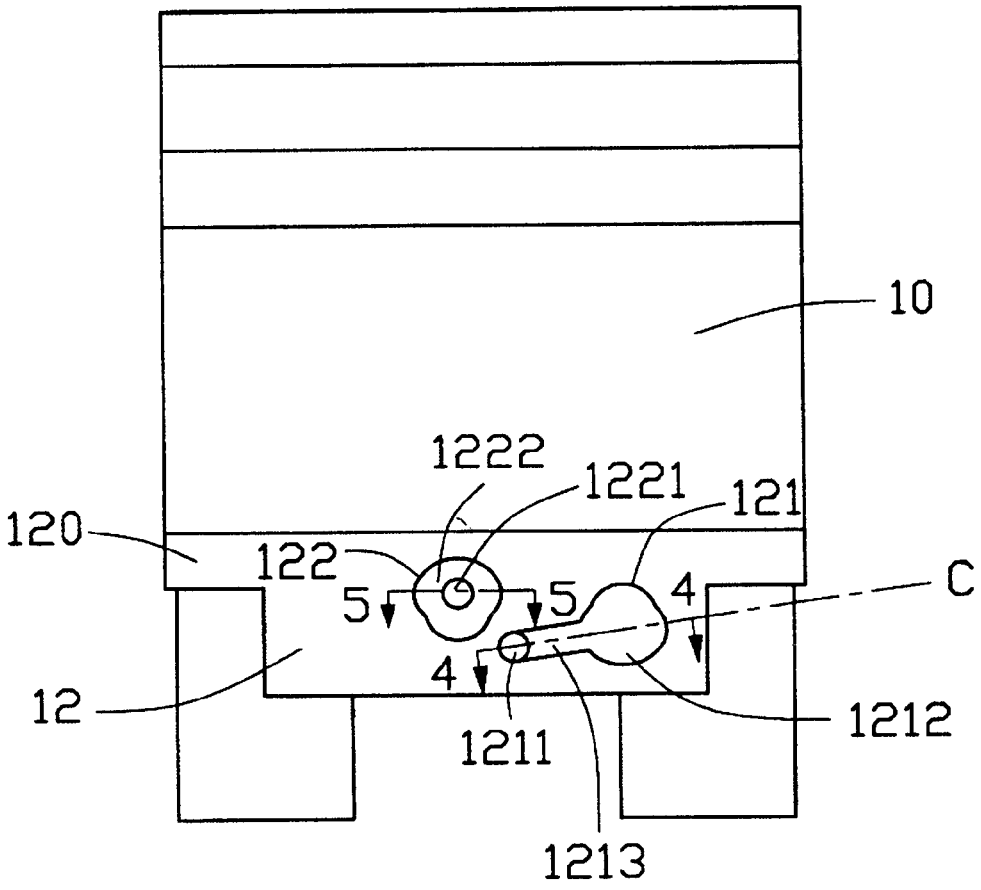
FIG. 3 is a rear view of the insulating housing shown in FIG. 1.

FIG. 3 shows a rear view of the insulating housing 10 to illustrate the relative positions of the two contact insertion holes 121, 122. The two contact insertion holes 121, 122 are spaced from each other a predeterminate distance, and are opened to a rear end 120 of the bottom wall 12 of the insulating housing 10. The first contact insertion hole 121 is adapted for receiving the first contact 20 therein, which has a solder portion 22 at a rear end thereof for soldering to one wire 4. The second contact insertion hole 122 is adapted for receiving a second contact 30 therein, which has a solder portion 32 for soldering to the other wire 4.

Figure 4:
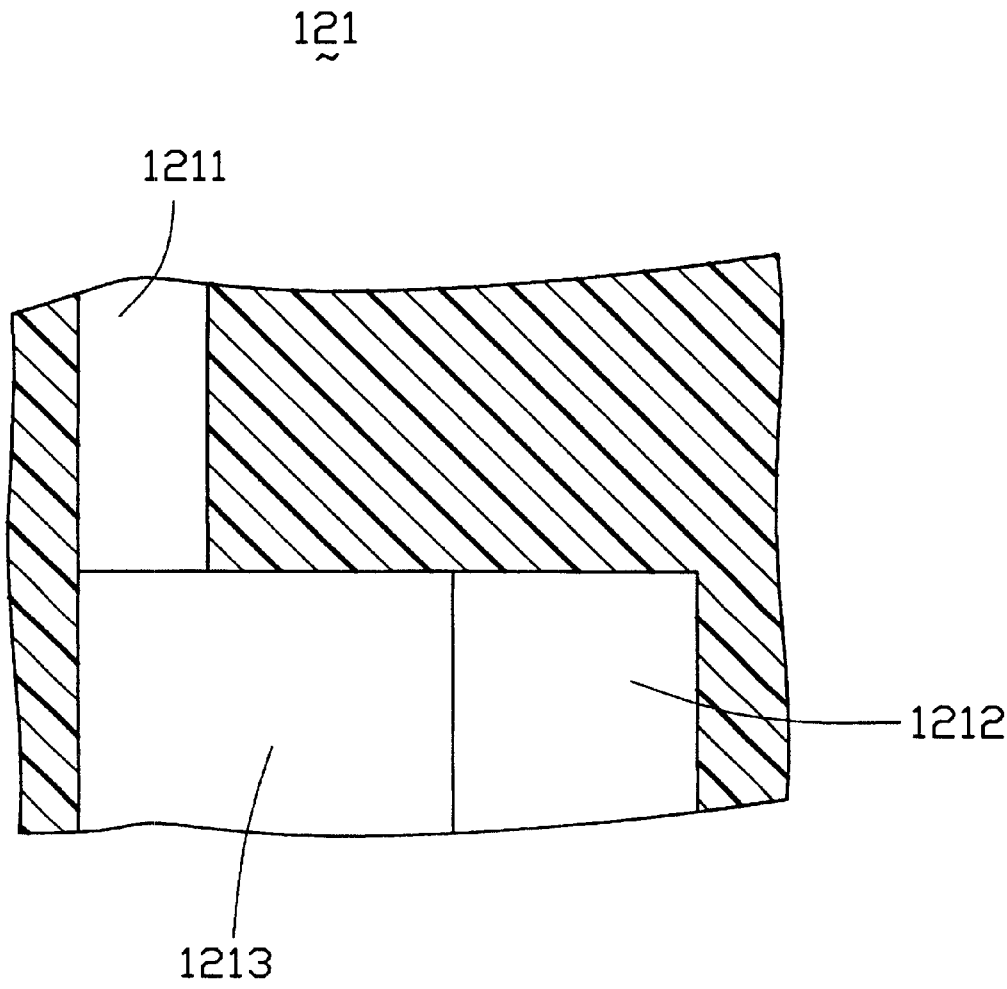
FIG. 4 is an enlarged, fragmentary, sectional view of the insulating housing taken along line 4—4 of FIG. 3.

Referring to FIG. 4, as indicated by the dotted line 4—4 of FIG. 3, a cross-sectional view of the first contact insertion hole 121 is shown with the first contact 20 being removed therefrom for clarity. The first contact insertion hole 121 includes a first hole 1211 passing through the bottom wall 12 of the housing 10, which is sized equal to the dimensions of an intermediate portion 23 of the first contact 20, and a second hole 1212, which is sized larger than the dimensions of the contact 20 for receiving the solder portion 22 and an end of the wire 4 soldered therewith. A gap 1213 is defined in the rear end 120 of the bottom wall 12 and communicates the first hole 1211 with the second hole 1212 for receiving a bent portion 25 of the first contact 20. Center lines of the first hole 1211 and the second hole 1212 are on a same plane "C" (FIG. 3), which inclines relative to the mounting face 123 of the housing 10 and forms an acute angle therebetween.

Figure 5:
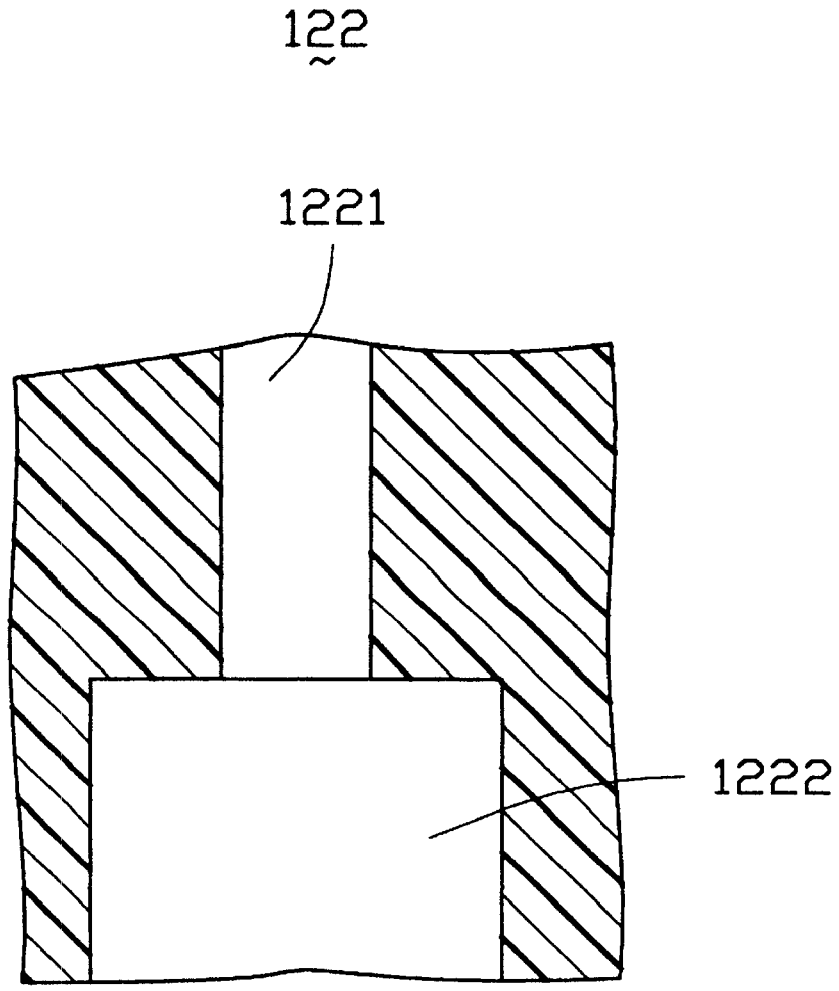
FIG. 5 is an enlarged, fragmentary, sectional view of the insulating housing taken along line 5—5 of FIG. 3.

Referring to FIG. 5, as seen from the dotted line 5—5 in FIG. 3, the second contact insertion hole 122 includes a first passageway 1221 for receiving an intermediate portion 33 of the second contact 30 and an enlarged second passageway 1222 communicating with the first passageway 1221 for receiving the straight solder portion 32 and an end of the other wire 4 soldered therewith. The first passageway 1221 has a same center line as the second passageway 1222, and is sized and shaped correspondingly to the dimensions of the second contact 30.

In assembly, referring to FIGS. 1 and 6, the first and the second contacts 20, 30 are substantially straight prior to insertion, except that the bent portion 25 of the first contact 20 is bent in advance. The pre-bent first contact 20 and the straight, second contact 30 are inserted into the two contact insertion holes 121, 122 from the rear end 120 of the housing 10 to the channels 13, whereby the solder portion 22 and the bent portion 25 of the first contact 20 are respectively received in the second hole 1212 and the gap 1213, and the intermediate portions 23, 33 of the first and the second contacts 20, 30 are correspondingly received in the first hole 1211 and the first passageway 1221. After insertion, contact portions 21, 31 of the first and the second contacts 20, 30 are folded back into the plug insertion hole 11, thereby forming the transition portions 24, 34 therewith, which are received separately in the two channels 13. Such configuration and relative positions of the two contact insertion holes 121, 122 facilitate the soldering procedure between the solder portions 22, 32 and the ends of the wires 4, and also, reduce the height of the modular jack 1 comparing with the prior art.

Figure 7:
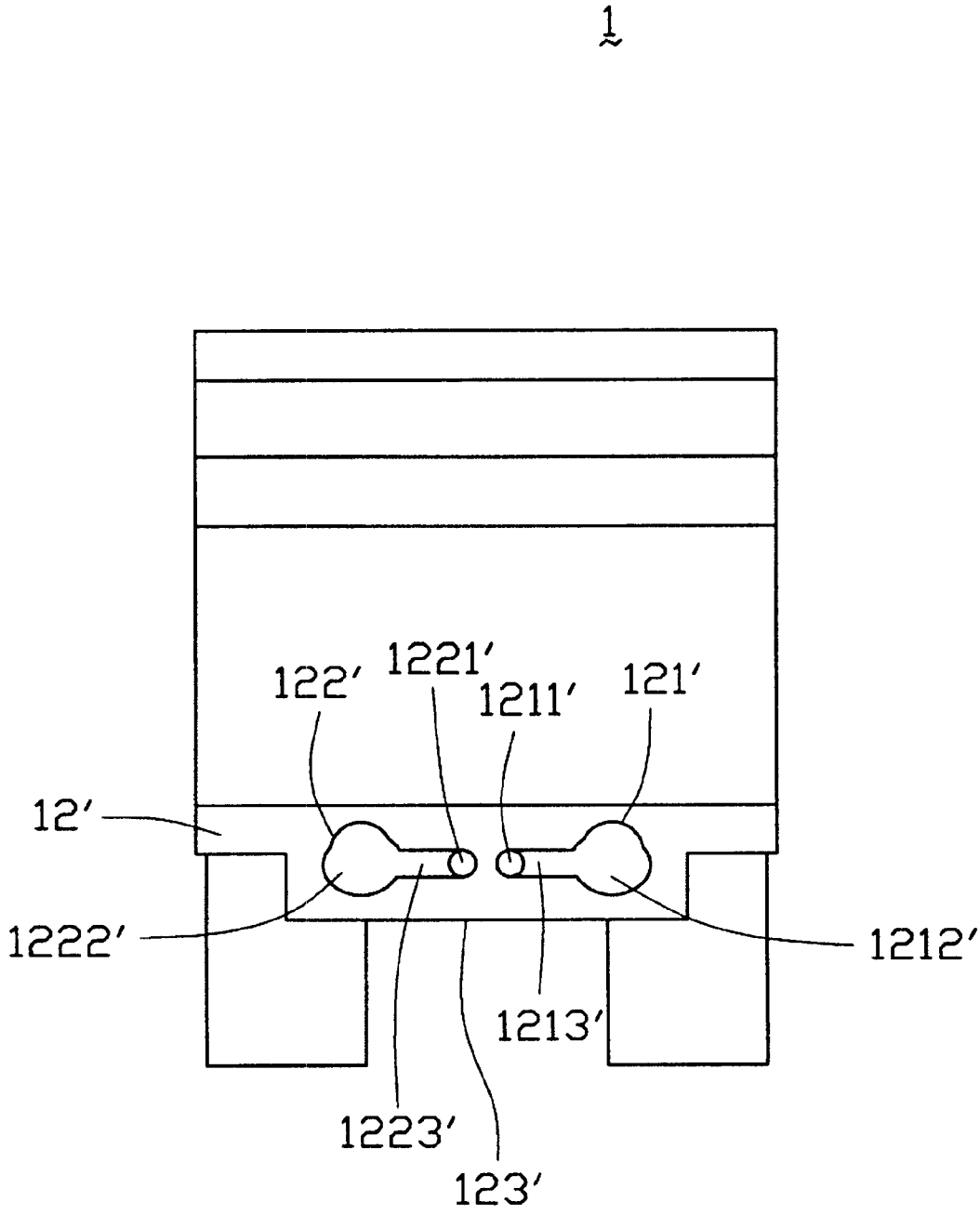
FIG. 7 is a rear view of an insulating housing of a modular jack in accordance with a second embodiment of the present invention.

Referring to FIG. 7, which shows a modular jack 1' of a second embodiment to illustrate the same concept of the invention, a pair of contact insertion holes 121', 122' are defined oppositely in a bottom wall 12' and arranged horizontally in a same row. Each contact insertion hole 121', 122' comprises a first through-hole 1211', 1221', a second enlarged hole 1212', 1222', and a middle gap 1213', 1223'. Center lines of the first through-holes 1211', 1221' and the second enlarged holes 1212', 1222' fall on a same plane, which is parallel to a mounting face 123' of the bottom wall 12'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack mounted on a printed circuit board for terminating with a pair of wires, comprising:

an insulating housing having a bottom wall, a plug insertion hole for receiving a complementary plug, and a first contact insertion hole and a second contact insertion hole defined in the bottom wall in a front-to-back direction of the bottom wall, the first contact insertion hole comprising a first hole defined through the bottom wall, a second hole defined in a rear end of the bottom wall, and a gap connecting the first hole with the second hole, center lines of the first and the second holes being spaced from each other, the second contact insertion hole comprising a first passageway defined through the bottom wall and a second passageway defined in the rear end of the bottom wall; and a first conductive contact and a second conductive contact received respectively in the first and the second contact insertion holes, each of the first and second conductive contacts including a contact portion extending into the plug insertion hole, an intermediate portion correspondingly received in the first hole or first passageway, and a solder portion correspondingly received in the second hole or second passageway, the first conductive contact further having a bent portion connecting the intermediate portion with the solder portion, the bent portion being received in the gap of the first contact insertion hole wherein the second hole of the first contact insertion hole is sized larger than the first hole, and the second passageway of the second contact insertion hole is sized larger than the first passageway;

wherein the first passageway and the second passageway of the second contact insertion hole have a same center line, and the second contact has a straight shape for insertion into the second contact insertion hole.

2. The modular jack as described in claim 1, wherein the bottom wall of the insulating housing defines a mounting face on a bottom side thereof, and center lines of the first and second holes of the first contact insertion hole fall on a same plane oblique to the mounting face and form therebetween an angle less than 90 degrees.

3. The modular jack as described in claim 2, wherein the center line of the first hole of the first contact insertion hole is closer to the mounting face of the housing than the center line of the second hole.

4. The modular jack as described in claim 3, wherein distance between the center lines of the second hole of the first contact insertion hole and the second passageway of the second contact insertion hole is larger than distance between the center lines of the first hole and the first passageway.

5. An electrical connector comprising:

an insulative housing including a bottom wall with a plug insertion hole thereabove;

first and second conductive contacts side by side positioned in the housing with contact portions extending into the plug insertion hole, each of said first and second contacts further including an intermediate portion received within the bottom wall;

first and second wires solderable to said first and second contacts, respectively; and said first contact including a bent portion generally horizontally laterally extending from a rear end of the corresponding intermediate portion and away from the second contact, said first contact further including a solder portion rearwardly extending from a distal end of said bent portion; wherein the intermediate portion of said first contact is structurally positioned between the intermediate portion of the second contact and the solder portion of the first contact in a horizontally lateral direction wherein said second contact further includes a bent portion generally horizontally laterally extending from a rear end of the intermediate portion and away from the first contact with a solder portion rearwardly extending from a distal end thereof, and wherein the solder portion of the second contact, the intermediate portion of the second contact, the intermediate portion of the first contact and the solder portion of the first contact, are arranged structurally spaced from one another along the horizontally lateral direction in sequence.

6. An electrical connector comprising:

an insulative housing with a bottom wall;

first and second contacts with intermediate portions side by side extending through said bottom wall in a front-to-back direction of the bottom wall;

first and second wires solderably connected to the corresponding first and second contacts, respectively;

the first contact further including a bent portion generally horizontally laterally extending from a rear end of the corresponding intermediate portion, and a solder portion rearwardly extending from a distal end of said bent portion;

a hole formed in a rear face of said bottom wall, said hole being dimensioned to be large enough to diametrically receive both the solder portion and the first wire therein, and a gap formed in said rear face, said gap communicating with both said hole and the corresponding intermediate portion, said gap being dimensioned to be long enough to longitudinally receive the bent portion therein.

* * * * *